US006361682B1

(12) United States Patent
Moretta et al.

(10) Patent No.: US 6,361,682 B1
(45) Date of Patent: Mar. 26, 2002

(54) PELLETIZATION OF PETROLEUM RESIDS

(75) Inventors: Jon C. Moretta; Pankaj M. Shah; Murugesan Subramanian, all of Houston, TX (US)

(73) Assignee: Kellogg Brown & Root, Inc., Houston, TX (US)

( * ) Notice: Subject to any disclaimer, the term of this patent is extended or adjusted under 35 U.S.C. 154(b) by 0 days.

(21) Appl. No.: 09/526,853

(22) Filed: Mar. 16, 2000

(51) Int. Cl.[7] ..... C10L 1/00
(52) U.S. Cl. ..... 208/39; 208/44
(58) Field of Search ..... 208/39, 44

(56) References Cited

U.S. PATENT DOCUMENTS

| | | | | |
|---|---|---|---|---|
| 2,616,837 | A | | 11/1952 | Roediger |
| 2,627,498 | A | | 2/1953 | Fink et al. |
| 2,861,939 | A | | 11/1958 | Biribauer et al. |
| 2,889,296 | A | | 6/1959 | Morris et al. |
| 3,015,128 | A | | 1/1962 | Somerville |
| 3,310,612 | A | | 3/1967 | Somerville |
| 3,462,359 | A | | 8/1969 | Fauber |
| 3,598,716 | A | | 8/1971 | Fauber |
| 3,751,278 | A | | 8/1973 | Alexander |
| 3,779,892 | A | | 12/1973 | Forster et al. |
| 3,868,315 | A | | 2/1975 | Forster et al. |
| 3,877,918 | A | | 4/1975 | Cerbo |
| 3,935,093 | A | | 1/1976 | Senolt et al. |
| 3,989,616 | A | | 11/1976 | Pagen et al. |
| 3,996,026 | A | | 12/1976 | Cole |
| 4,052,290 | A | | 10/1977 | Cushman et al. |
| 4,123,206 | A | | 10/1978 | Dannelly |
| 4,207,117 | A | | 6/1980 | Espenscheid et al. |
| 4,218,409 | A | | 8/1980 | Dannelly |
| 4,283,230 | A | | 8/1981 | Clementoni et al. |
| 4,332,671 | A | | 6/1982 | Boyer |
| 4,386,895 | A | | 6/1983 | Sodickson |
| 4,526,588 | A | | 7/1985 | Lusch |
| 4,657,702 | A | | 4/1987 | Vasconcellos et al. |
| 4,681,700 | A | | 7/1987 | Vasconcellos et al. |
| 4,769,288 | A | * | 9/1988 | Skylak ..... 428/403 |
| 4,931,231 | A | | 6/1990 | Teppo et al. |
| 4,933,067 | A | | 6/1990 | Rankel |
| 4,950,307 | A | | 8/1990 | Najjar et al. |
| 4,975,176 | A | | 12/1990 | Begliardi et al. |
| 5,228,977 | A | | 7/1993 | Moran et al. |
| 5,320,739 | A | | 6/1994 | Moran et al. |
| 5,637,350 | A | | 6/1997 | Ross |
| 5,932,186 | A | | 8/1999 | Romine et al. |
| 5,939,474 | A | | 8/1999 | Gooswilligen et al. |

FOREIGN PATENT DOCUMENTS

| | | |
|---|---|---|
| AU | 9705216 | 2/1997 |

* cited by examiner

*Primary Examiner*—Helane E. Myers

(57) ABSTRACT

Disclosed are an integrated process and plant for slurrying and gasification or combustion of a petroleum resid such as asphaltenes from to make a synthesis gas or steam and/or power. The resid is prilled into a gaseous medium as a liquid with a rotating prilling head to form particles which form into a spherical shape. The liquid particles are directly quenched with a water spray to form a slurry of resid particles in water. The slurry comprises a solids loading of 50 to 80 percent and can also include a minor amount of a dispersant.

20 Claims, 4 Drawing Sheets

PELLETIZATION OF PETROLEUM RESIDS

FIELD OF THE INVENTION

The present invention is directed to a process and a plant for slurrying and oxidation of a petroleum resid with water. More particularly, the invention is directed to integrating the slurrying with oxidation, by prilling the resid at an elevated temperature to form liquid particles of the resid in a gaseous medium and directly quenching the particles with cooling water to form a pumpable slurry for oxidation.

BACKGROUND OF THE INVENTION

As the maturity of petroleum refining progresses, more and more of the crude oil is converted to useful light products. The bottom of the barrel, petroleum resid, becomes more and more difficult to dispose of in an economical, useful manner. The residue from petroleum refining has a wide number of uses, including paving asphalt, fuel and feedstock for gasification to form a synthesis gas. Each of these uses for the resid has a number of disadvantages. Paving grade asphalt used in road construction must meet a number of specifications, including viscosity (usually 200–5000 poises at 60° F.), penetration (usually greater than 30 to 200 dmm), penetration ratio 15° F./25° F. (usually above about 0.3), ductility, temperature susceptibility, and others. Because of the narrow specifications for paving asphalt, it is becoming more and more difficult for resids to meet the needed paving asphalt specifications.

In contrast to paving asphalt, the specifications for petroleum resid that is burned as a fuel or used as feed in a partial oxidation gasifier, are less stringent. The resid generally has a higher calorific value and better combustion characteristics compared to coal and petroleum coke. Unfortunately, heavy resid poses storage and handling problems for use as a liquid fuel since it must be kept at an elevated temperature or a high value lighter hydrocarbon is used as a diluent to keep it in liquid state.

In the gasification of resid, it is also typical for water or steam to be introduced into the gasifier as a temperature moderator and hydrogen source. In the gasification of coal and coke, these materials are commonly supplied to the gasification reactor in the form of a water slurry. Much work has gone into formation and maintenance of the coke/coal slurry. The coal or coke is usually ground to a fine particle size and mixed with water to make a pumpable slurry. Factors such as particle size and water content are usually critical to obtain a pumpable slurry which can be supplied to the gasification reactor. For example, if the particle size is too large or the water content is too low, the viscosity of the slurry will be too high to be easily pumped. On the other hand, if the water content is too high, it may be necessary to supplement the feed to the gasification reactor with a liquid hydrocarbon feedstock. Various references discussing slurrying of coke and/or coal for gasification or combustion include U.S. Pat. No. 3,996,026 to Cole; U.S. Pat. No. 4,526,588 to Lusch et al; U.S. Pat. Nos. 4,657,702 and 4,681,700 to Vasconcellos et al; U.S. Pat. No. 4,950,307 to Najjar et al; and WO 97/05216 to Isentropic Systems Ltd.

U.S. Pat. No. 5,478,365 to Nikanjam et al discloses a combustible heavy hydrocarbon-in-water emulsion containing a phosphate ester, a high molecular weight thickener, a high softening point hydrocarbon material and 25–50 weight percent water. The emulsion is made in a colloid mill by mixing the components at an elevated temperature and pressure to keep the hydrocarbon material from solidifying and the water from vaporizing, and then cooling the emulsion.

U.S. Pat. No. 4,931,231 to Teppo et al discloses a method for manufacturing discrete pellets of asphaltic material by flowing the asphaltic material in molten form as an elongated annular stream directly into cooling water to solidify and shatter the elongated stream into discrete solid particles. The particles formed as a result of shattering are not spherical and have undesirable flow and/or handling characteristics.

A pelletizer apparatus and method for pelletizing a hard petroleum resid is disclosed in our earlier copending application U.S. Ser. No. 09/447,408, filed Nov. 23, 1999. This disclosure involves the prilling of the resid at a temperature at which it is liquid, allowing the resid particles to form a substantially spherical shape, and then quenching the particles to solidify them in their spherical shape.

SUMMARY OF THE INVENTION

In the present invention liquid asphaltenes from solvent desasphalting or another petroleum resid material are pumped to an extrusion device to produce liquid particles in a gaseous medium that are quenched with water to form a slurry of hydrocarbon particles of the appropriate size distribution suitable for pumping and combustion/gasification without further grinding or processing.

In one aspect, the present invention provides a process for the slurrying and oxidation of a petroleum resid, comprising the steps of:

(a) heating petroleum resid to a temperature at which it is in a liquid state;

(b) forming the resid into finely divided particles in a gaseous medium;

(c) directly quenching the resid particles with water to form a pumpable slurry of solidified resid particles; (d) pumping the slurry to an oxidation reactor; and (e) injecting the slurry into the oxidation reactor and oxidizing the resid in the reactor. The resid preferably has a softening point temperature above about 185° F. The process can also include solvent deasphalting a petroleum residue to form a deasphalted oil fraction, an optional resin fraction and an asphaltene fraction, and supplying the asphaltene fraction as the petroleum resid for the heating step (a).

The particle-forming step (b) and the quenching step (c) preferably comprise: (1) continuously feeding the liquid petroleum resid from step (a) to an inlet of a centrifugal prilling head comprising a plurality of radially arrayed discharge orifices; (2) rotating the prilling head to discharge liquid petroleum resid from the orifices into free space at an upper end of a prilling vessel having a diameter larger than a throw-away diameter of the discharged petroleum resid; (3) allowing the discharged resid to break apart and form into particles in a high temperature zone of the prilling vessel at which the petroleum resid is liquid and fall downwardly into a water bath maintained at a temperature effective to solidify the particles and form the pumpable slurry; and (4) withdrawing the slurry from the prilling vessel. The discharge orifices are preferably arrayed at a circumference of the prilling head in a plurality of vertically spaced upper and lower rows wherein the lower row or rows are disposed at a smaller radius from an axis of rotation of the prilling head than the upper row or rows. The prilling head can have a circumference tapered from an uppermost row to a lowermost row. Preferably, the prilling head is rotated at from about 200 to about 10,000 rpm, the prilling head has a diameter from about 2 inches to about 5 feet, the orifices have a diameter from about 1/32-inch to about 1-inch and a capacity of from about 1 to about 1000 lbs/hr of resid per orifice, the throw-away diameter is from about 1 foot to about 15 feet and the particles have a size range larger than about 0.01 mm and smaller than about 1 mm.

The water bath is preferably maintained in the prilling vessel at a temperature from about 40° to about 190° F. The water can be introduced into the prilling vessel as an inwardly directed spray in a cooling zone above the water bath to at least partially cool the particles before they enter the bath. The quenching water can pass once through the prilling vessel, essentially free of recirculation, and wherein the slurry from the prilling vessel has a solids content from 50 to 80 percent. If necessary, water can be added to or removed from the slurry and recirculated to the prilling vessel. A dispersant can be admixed into the slurry to aid pumpability. The slurry can have an apparent viscosity less than about 2000 cSt, and preferably comprises from 60 to 70 weight percent solids and has an apparent viscosity from about 100 to about 300 cSt. The particles preferably have a size less than 0.05 mm.

The oxidation reactor can be a gasifier that converts the petroleum resid to synthesis gas, or a combustion reaction that burns the petroleum resid to produce steam. The gasification reactor can be a high temperature, entrained flow, slagging type, oxygen or air blown gasifier operated at a temperature from about 1800° to about 2600° F. and a pressure from about 400 to about 1200 psig.

In another aspect, the present invention provides a plant for petroleum refinery bottoms processing. The plant includes an atmospheric distillation unit, a solvent deasphalting unit, a slurrying unit and an oxidation reactor. The atmospheric distillation unit fractionates atmospheric tower bottoms into naphtha, diesel and atmospheric resid fractions. The solvent deasphalting unit separates the atmospheric resid fraction into a deasphalted oil fraction and an asphaltene fraction. The slurrying unit forms the asphaltene fraction into finely divided particles in a gaseous medium at a temperature at which the asphaltene fraction is liquid, and directly quenches the particles with water to form a pumpable slurry of solidified asphaltene particles. The oxidation reactor at least partially oxidizes the asphaltene particles at elevated temperature. One or more pumps are provided for pumping a stream of the slurry from the slurrying unit to the oxidation reactor.

The asphaltene slurry stream preferably comprises from about 50 to about 80 weight percent solids, has a viscosity less than about 2000 cSt, and the asphaltene particles are substantially between 0.01 and 1 mm. The asphaltene slurry stream preferably includes from 1 ppmw up to 2 weight percent of a non-foaming dispersant.

The slurrying unit preferably comprises an upright prilling vessel having an upper prilling zone, a hot discharge zone below the prilling zone, a cooling zone below the discharge zone, and a lower cooling bath below the cooling zone. A centrally disposed prilling head in the prilling zone is rotatable along a vertical axis and has a plurality of discharge orifices for throwing asphaltene radially outwardly. A throw-away diameter of the prilling head is less than an inside diameter of the prilling vessel. A line supplies a hot, liquid asphaltene stream comprising the asphaltene fraction to the prilling head. A heater can be used for heating the asphaltene stream supplied to the prilling head. The vertical height of the discharge zone is sufficient to allow asphaltene discharged from the prilling head to form into liquid droplets. Nozzles are provided for spraying water inwardly into the cooling zone to cool and at least partially solidify the liquid droplets to be collected in the bath and form a slurry of solidified asphaltene particles in the bath. A line supplies water to the nozzles and the bath to maintain a depth of the bath in the prilling vessel. Another line is provided for withdrawing the slurry of the asphaltene particles in the bath water from the prilling vessel.

The discharge orifices are preferably arrayed at a circumference of the prilling head in a plurality of vertically spaced upper and lower rows wherein the lower row or rows are disposed at a smaller radius from the axis of rotation of the prilling head than the upper row or rows. The prilling head can have a circumference tapered from an uppermost row to a lowermost row. The prilling head can have a plurality of rings of different diameter with orifices formed in an outer circumference of each ring, wherein the rings are secured to the prilling head in a descending fashion wherein each successively lower ring has a smaller diameter than the preceding ring. A drive can rotate the prilling head at from about 200 to about 10,000 rpm. The prilling head preferably has a diameter from about 6 inches to about 5 feet, and the orifices lo have a diameter from about 1/32-inch to about 1-inch and a capacity of from about 1 to about 1000 lbs/hr of asphaltene per orifice.

The prilling vessel can also have a conical bottom containing the bath and a discharge at a lower end of the conical bottom for feeding the slurry into the withdrawal line.

The oxidation reactor can be a gasifier or a combustion reactor.

DETAILED DESCRIPTION

The petroleum resids which are suitable for slurrying in accordance with the present invention include any asphaltene-rich material, particularly the asphaltene fraction from solvent deasphalting with propane or another solvent as practiced in solvent deasphalting process technology commercially available under the trade designations ROSE, DEMEX, SOLVAHL and the like. The term "resid" as used in the present specification and claims also encompasses other asphaltene-containing sources from petroleum resids such as, for example, atmospheric tower bottoms, vacuum tower bottoms, visbreaker residue, thermal cracker residue, soaker residue, hydrotreater residue, hydrocracker residue, and the like.

The best practical use of the invention is achieved by employing a petroleum resid which has a R&B softening point temperature of at least about 185° F., preferably at least 200° F. As used herein, the R&B softening point temperature is measured per ASTM D3461-85.

Figure 1:
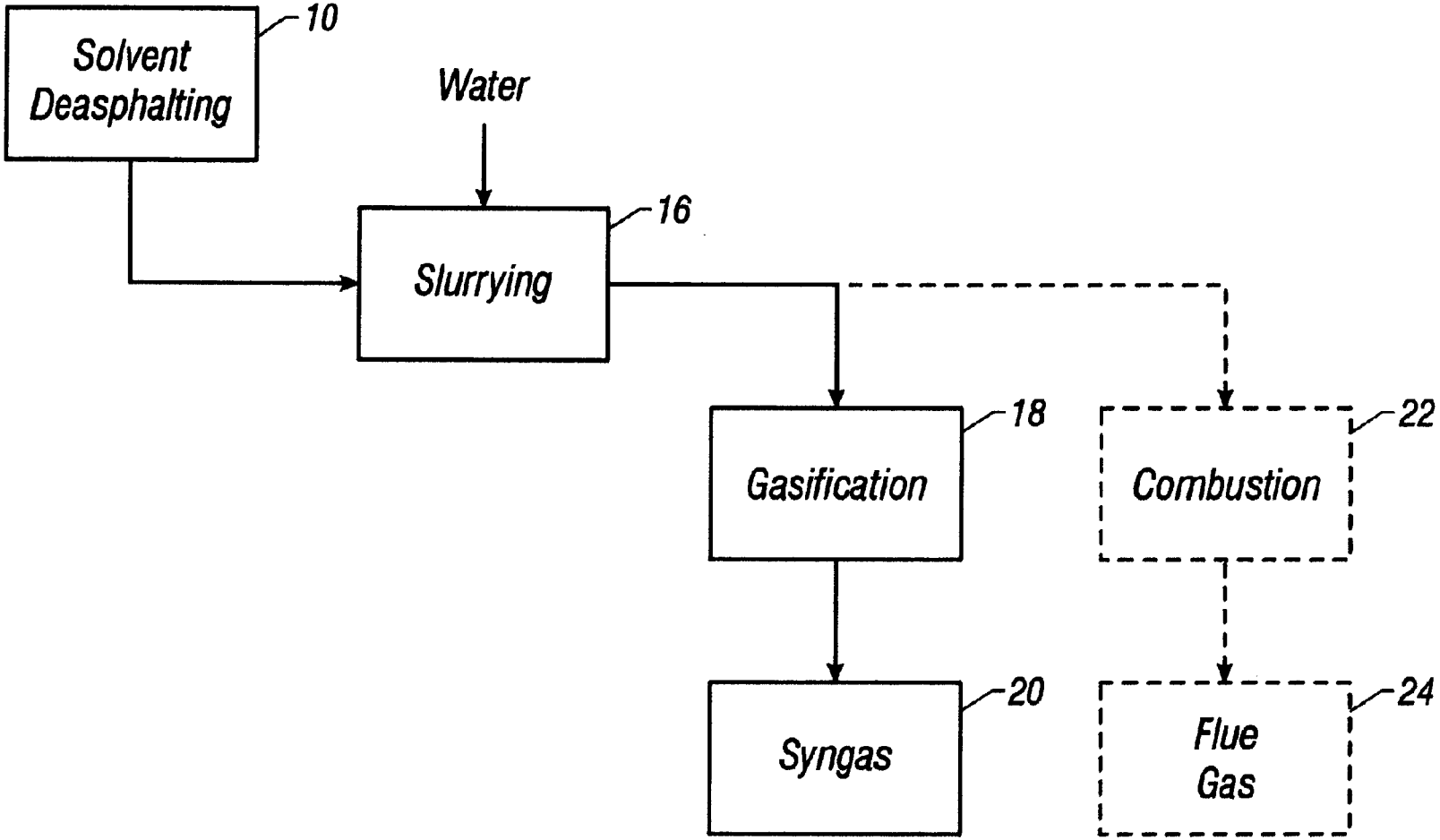
FIG. 1 is a simplified process flow diagram of an embodiment of the method of slurrying and gasifying a petroleum resid according to the present invention.

This invention is a process that produces a slurry of particles from petroleum resids. In accordance with one embodiment of the invention shown in FIG. 1, the asphaltene fraction from solvent deasphalting unit 10 is slurried with water using a slurrying step 16 which preferably employs a centrifugal prilling device. The centrifugal prilling device has a high prilling capacity, flexibility to produce particles of small size and from a variety of resids, ease of operation, self-cleaning capability, and ease of startup and shut down.

The slurrying step 16 produces particles that are substantially spherical with good slurry and gasification and/or combustion characteristics. The slurry from the slurrying step 16 is reacted in the gasification unit 18 which is adapted for gasification of a slurried particulate feed in a manner well known to those skilled in the art. The gasification step typically involves reaction of the resid particles with oxygen, usually in the form of high purity oxygen, enriched oxygen or sometimes air, in the presence of water from the slurry, although additional water/steam, as well as a supplemental feedstock such as coal or petroleum coke can also be supplied to the unit 18. The synthesis gas 20 from the gasification unit 18 will contain primarily hydrogen, carbon monoxide or a combination thereof. The gasification reactor is typically operated at a temperature of from about 1800° to about 2600° F., preferably above 2300° F. The pressure of the gasification reactor is typically from 400 to 1200 psig. Alternatively, a combustion reactor 22 could be alternatively or additionally used to produce heat to generate steam and/or power 24.

The resid can be slurried by any process and equipment that forms the resid into discrete particles in a gaseous phase and quenches the particles so formed directly with water to form the slurry. We prefer to form the particles in a gaseous medium at a temperature at which the resid is in a liquid state to allow the particles to form, by surface tension which should exceed viscous and inertial forces, into rounded or spherical particles. After the particles are formed in the gaseous medium, which can be air or steam or another inert fluid, they are quenched by direct contact with cooling water, which can be in the form of a spray or bath. Pressurized nozzles or spray nozzles, for example, can be used to form the liquid petroleum resid particles, provided the particle size, particle shape, and particle size distribution which result are sufficient to form a pumpable, combustible slurry.

Figure 2:
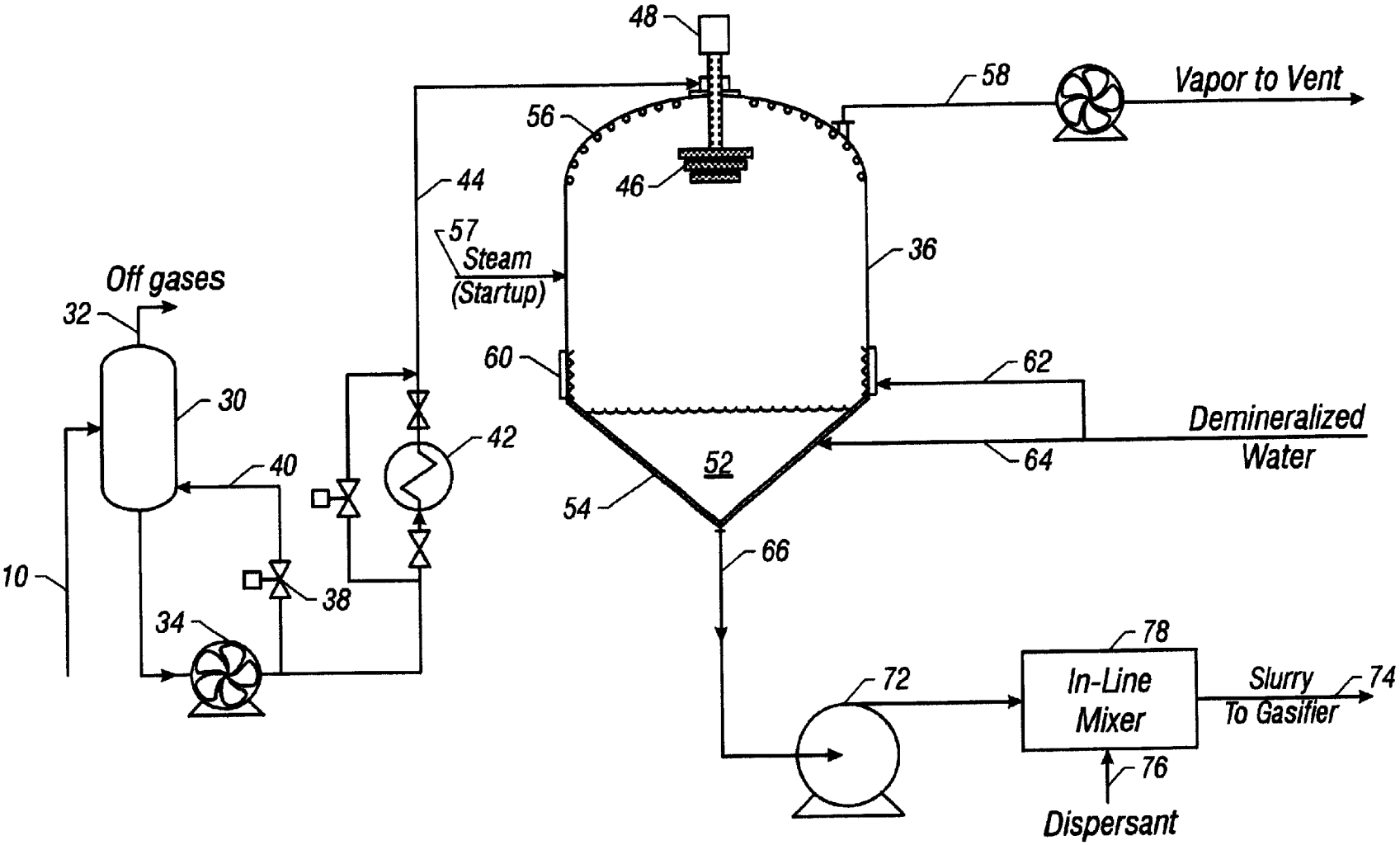
FIG. 2 is a simplified flow diagram of slurrying equipment according to an embodiment of the invention.

With reference to FIG. 2, which shows slurrying with the preferred rotating prilling device, the resid 10 is fed to surge drum 30. The purpose of the surge drum 30 is to remove residual solvent contained in the resid (e.g., from asphaltenes recovered from solvent deasphalting processes), which is vented overhead in line 32, and also to provide a positive suction head for pump 34. The pump 34 delivers the resid to the prilling vessel 36 at a desirable flow rate. A spill back arrangement, including pressure control valve 38 and return line 40, maintains resid levels in the surge drum 30 and also adjusts for the fluctuations in production rates. The resid from the pump 34 flows through resid trim heater 42 where the resid is heated to the desired operating temperature for successful particle formation. A typical outlet temperature from the resid trim heater 42 ranges from about 350° to about 650° depending on the viscosity and R&B softening point temperature of the resid.

The hot resid flows via line 44 to the top of the prilling vessel 36 where it passes into the rotating prilling head 46. The rotating head 46 is mounted directly on the top of the prilling vessel 36 and is rotated using an electrical motor 48 or other conventional driver. The rotating head 46 is turned at speeds in the range of from about 10 to about 10,000 RPM, preferably at least about 100 RPM, and more preferably at least about 500 RPM.

Figure 3:
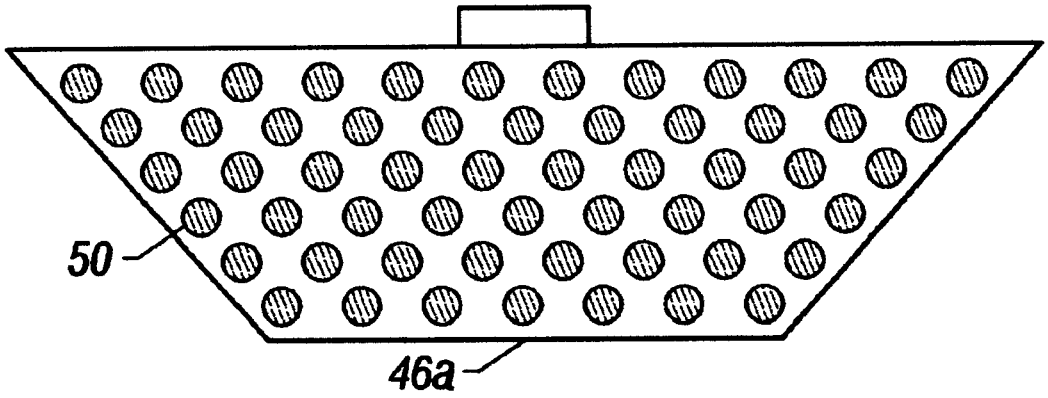
FIG. 3 is a simplified schematic of one embodiment of a prilling head according to the present invention.
Figure 4:
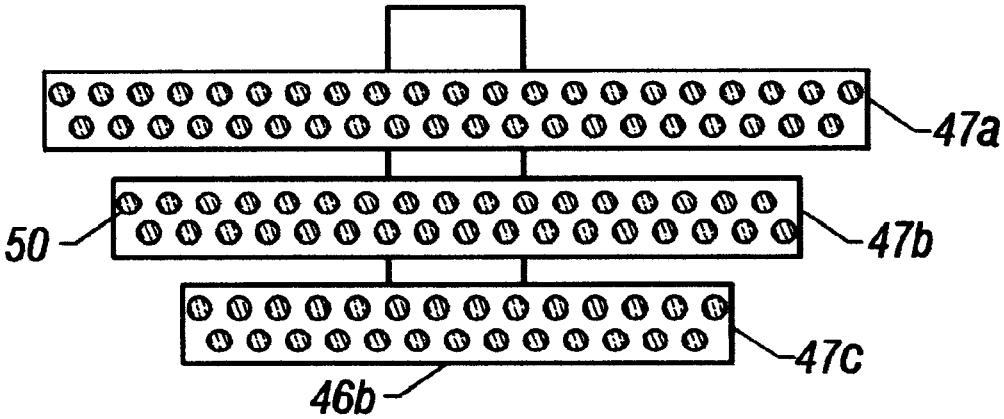
FIG. 4 is a simplified schematic of an alternative embodiment of a prilling head according to the present invention.

The rotating head 46 can be of varying designs including, but not limited to the tapered basket 46*a* or multiple diameter head 46*b* designs shown in FIGS. 3 and 4, respectively. The orifices 50 are evenly spaced on the circumference of the heads 46*a*,46*b* in one or more rows in triangular or square pitch or any other arrangement as discussed in more detail below. The orifice 50 diameter can be varied from about 0.03 to about 1 inch (about 0.8 to 25 mm), preferably less than 0.5 inch (12.7 mm) to produce the desired particle size and distribution. The combination of the rotating head 46 diameter, the RPM, the orifice 50 size and fluid temperature (viscosity) controls the particle size and size distribution, resid throughput per orifice and the throw-away diameter of the particles. As the resid enters the rotating head 46, the centrifugal force discharges long, thin cylinders of the resid into the free space at the top of the prilling vessel 36. As the resid travels outwardly and/or downwardly through the prilling vessel 36, the resid breaks up into spherical particles as the surface tension force overcomes the combined viscous and inertial forces. The particles fall spirally into the cooling water bath 52 (see FIG. 2) which is maintained in a preferably conical bottom 54 of the prilling vessel 36. The horizontal distance between the axis of rotation of the rotating head 46 and the point where the particle stops travelling away from the head 46 and begins to fall downwardly is called the throw-away radius. The throw-away diameter, i.e. twice the throw-away radius, is preferably less than the inside diameter of the prilling vessel 36 to keep particles from hitting the wall of the vessel 36 and accumulating thereon.

Steam, electrical heating coils or other heating elements 56 may be provided inside the top section of the prilling vessel 36 to keep the area adjacent the head 46 hot while the resid flows out of the rotating head 46. Heating of the area within the top section of the prilling vessel 36 is used primarily during startup, but can also be used to maintain a constant vapor temperature within the prilling vessel 36 during regular operation. If desired, steam can be introduced via line 57 to heat the vessel 36 for startup in lieu of or in addition to the heating elements 56. The introduction of steam at startup can also help to displace air from the prilling vessel 36, which could undesirably oxidize the resid particles. The maintenance of a constant vapor temperature close to the resid feed 44 temperature aids in overcoming the viscous forces, and can help reduce the throw-away diameter and stringing of the resid. The vapors generated by the hot resid and steam from any vaporized cooling water leave the top of the vessel 36 through a vent line 58 and are recovered or combusted as desired.

The particles travel spirally down to the cooling water bath 52 maintained in the bottom section of the prilling vessel 36. A water mist, generated by spray nozzles 60, preferably provides instant cooling and hardening of the surface of the particles, which can at this stage still have a molten core. The surface-hardened particles fall into the water bath 52 where the water enters the bottom section of the prilling vessel 36 providing turbulence to aid in removal of the particles from the prilling vessel 36 and also to provide further cooling of the particles. Low levels (less than 20 ppm) of one or more non-foaming surfactants from various manufacturers, including but not limited to those available under the trade designations TERGITOL and TRITON, may be used in the cooling water to facilitate soft landing for the particles to help reduce flattening of the spherical particles. The cooling water flow rate is preferably maintained to provide a temperature increase of from about 10° to about 50° F., more preferably from about 15° to about 25° F., between the inlet water supply via lines 62,64 and the outlet line 66.

The particles and cooling water flow as a slurry out of the prilling vessel 36 to a slurry pump 72. The slurry pump 72 pumps the slurry into line 74 for supply to the oxidation reactor (not shown). If desired, a non-foaming dispersant from line 76 can be mixed into the slurry using an in-line mixer 78. The dispersant is generally used at from 2 ppmw up to about 2 weight percent of the slurry. Dispersants are commercially available under the trade designations T-MULZ, KELZAN, PLURADYNE, ORZANAE and the like. A surge tank or holdup drum (not shown) can be used upstream and/or downstream from the slurry pump 72, with or without additional slurry pumps, as desired. Generally, such tanks or drums can be agitated to maintain the slurry in suspension and/or the residence time therein can be limited to avoid settling.

Typical operating conditions for the slurrying apparatus of FIG. 2 are as shown in Table 1 below:

TABLE 1

Typical Slurrying Unit Operating Conditions

| Condition | Range | Preferred Range |
|---|---|---|
| Resid feed temperature | 350° to 700° F. | 400 to 600° F. |
| Pressure | 1 atmosphere to 200 psig | Less than 50 psig |
| Head Diameter, in. | 2 to 60 | 6 to 36 |
| Head RPM | 10 to 10,000 | 500 to 10,000 |
| Orifice Size, in. | 0.03 to 1 | Less than 0.5 |
| Orifice Pitch | Triangular or square | |
| Orifice capacity | 1 to 1000 lbs/hr per orifice | Up to 400 lbs/hr per orifice |
| Throw-away diameter | 2 to 15 feet | 4 to 15 feet |
| Cooling water in, °F | 40 to 165 | 60 to 140 |
| Cooling water out,°F | 70 to 190 | 75 to 165 |
| Cooling water ΔT, °F | 10 to 150 | 15 to 25 |
| Particle size, mm | 0.01 to 1 | 0.015 to 0.05 |

The present invention discloses the use of the centrifugal extrusion device 46 to slurry petroleum resids. The centrifugal extrusion device 46 results in a low-cost, high-throughput, flexible and self-cleaning device to particulate the resids. The orifices 50 are located on the circumference of the rotating head 46, which can have a hollow central chamber (not shown) of generally uniform inside diameter. The number of orifices 50 required to achieve the desired production is increased by increasing the head 46 diameter and/or by decreasing the distance between the orifices 50 in a row and axially spacing the orifices 50 at multiple levels. The orifices 50 can be spaced axially in triangular or square pitch or another configuration.

The rotating head 46 can be of varying designs including, but not limited to the tapered basket 46*a* or multiple diameter head design 46*b* shown in FIGS. 3 and 4, respectively. The combination of the head 46 diameter and the speed of rotation determine the centrifugal force at which the resid extrudes from the centrifugal head 46. By providing orifices 50 at different circumferences of the head 46*b*, for example, it is believed that any tendency for collision of molten/sticky particles is minimized since there will be different throw-away diameters, thus inhibiting agglomeration of resid particles before they can be cooled and solidified. If desired, different rings 47*a–c* in the head 46*b* can be rotated at different speeds, e.g. to obtain about the same centrifugal force at the respective circumferences.

Besides speed of rotation and diameter of the head 46, the other operating parameters are the orifice 50 size, resid temperature, surrounding temperature, size of the resid flow channels inside the head 50 (not shown), viscosity and surface tension of the resid. These variables and their relation to the particle size, production rate per orifice, throw-away diameter and the jet breaking length are explained below.

The orifice 50 size affects the particle size. A smaller orifice 50 size produces smaller particles while a larger size produces larger particles for a given viscosity (temperature), speed of rotation, diameter of the head 46 and throughput. The throw-away diameter increases with a decrease in orifice 50 size for the same operating conditions. Adjusting the speed of rotation, diameter of the head 46 and throughput, the particles can be produced with a varied range of sizes. Depending on the throughput, the number of orifices 50 can be from 10 or less to 700 or more.

The speed of rotation and diameter of the centrifugal head 46 affect the centrifugal force at which the extrusion of the resid takes place. Increasing the RPM decreases the particle size and increases the throw-away diameter, assuming other conditions remain constant. Increase in head 46 diameter increases the centrifugal force, and to maintain constant centrifugal force, the RPM can be decreased proportionally to the square root of the ratio of the head 46 diameters. For a higher production rate per orifice 50, greater speed of rotation is generally required. The typical RPM range is 100 to 10,000. The centrifugal head 46 diameter can vary from 2 inches to 5 feet in diameter.

The viscosity of the resid generally increases exponentially with a decrease in temperature. The resid viscosities at various temperatures can be estimated by interpolation using the ASTM technique known to those skilled in the art, provided viscosities are known at two temperatures. The viscosity affects the size of the particles produced, the higher viscosity of the resid producing larger particles given other conditions remain constant.

Figure 5:
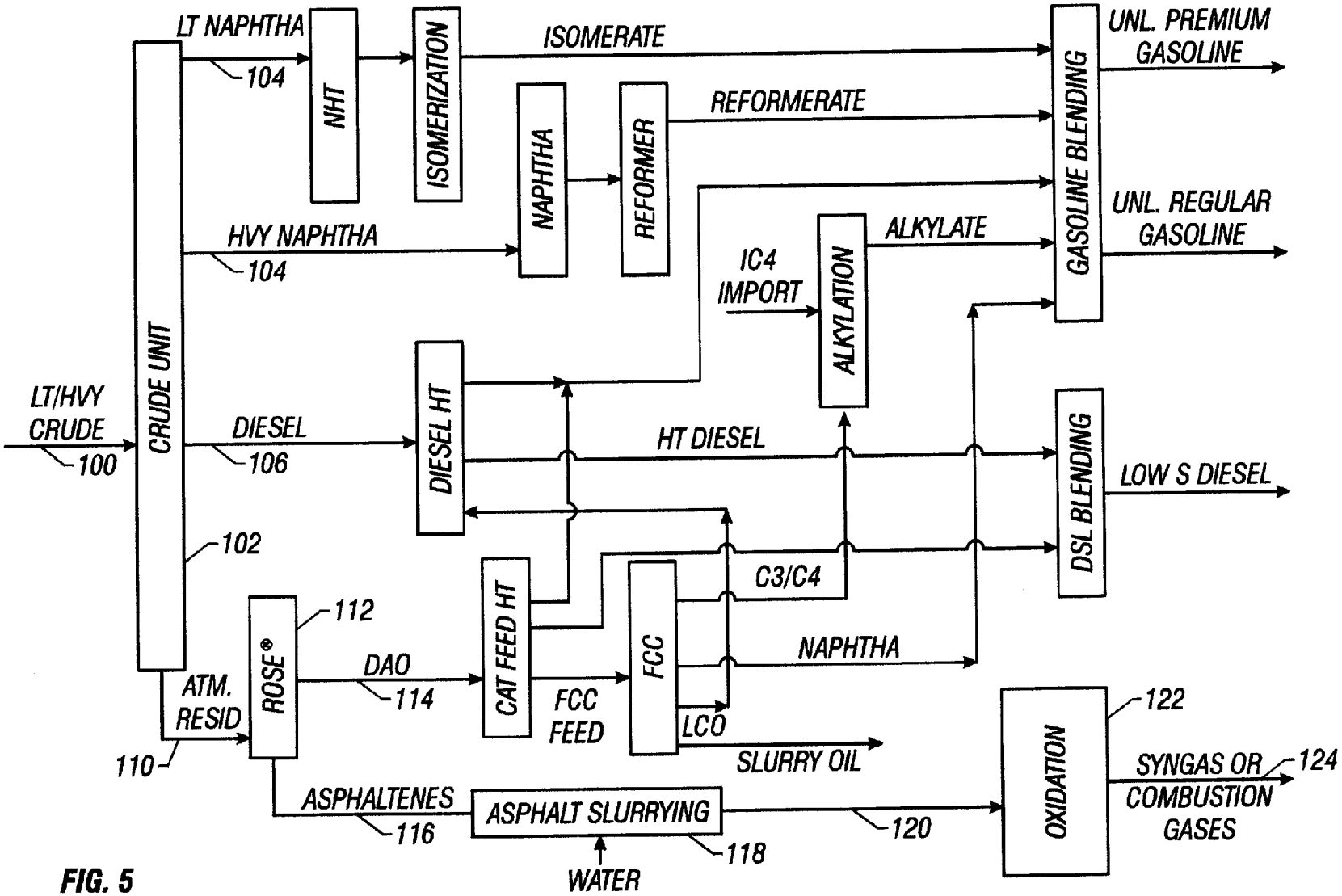
FIG. 5 is a simplified schematic flow diagram of a crude petroleum processing plant according to one embodiment of the invention showing solvent deasphalting of an atmospheric resid with slurrying and gasification of the asphaltenes from the solvent deasphalting unit to produce synthesis gas.

With reference to FIG. 5, there is shown a typical refinery with a bottoms processing plant using slurrying in accordance with the principles of the present invention. The crude oil 100 is supplied to distillation unit 102 to form naphtha and diesel fractions 104 and 106, respectively, and a resid stream 110. The resid stream 110 is fed to deasphalting unit 112, which is preferably a ROSE® unit, to obtain one or more deasphalted oil (DAO) streams 114 and asphaltenes stream 116. The asphaltenes are slurried with water in accordance with the present invention in slurrying unit 118, and the resulting slurry is supplied by line 120 to oxidation unit 122 to obtain gas stream 124, which is synthesis gas or hot combustion gases. As is well known, the composition of synthesis gas 124, after removal of water, sulfur oxides, carbon dioxide or the like, can vary from nearly pure hydrogen to nearly pure carbon monoxide, including any desired ratios of hydrogen and carbon monoxide.

EXAMPLES 1 AND 2

Experiments were performed with two petroleum resids produced from solvent deasphalting, which had R&B softening point temperatures of 265° and 292° F. The setup consisted of a feed tank oven, resid pump, heated feed line, seals to transfer the resid to the centrifugal head, a multi-orifice centrifugal head, motor and belt to rotate the head, and a particle collection tray. The resid was heated to the desired operating temperature in the drum oven and pumped to the rotating centrifugal head by the resid pump. The resid pump was a gear pump capable of pumping up to 5 gpm. High temperature, moderate pressure seals provide a positive leakproof connection between the feed line and the centrifugal head while transferring the resid.

The pump was calibrated before each prilling experiment. As the resid entered the centrifugal head, the centrifugal force discharged long, thin cylinders of the resid into the free space at the top of the prilling vessel. As the resid traveled downwardly in the vapor space, the resid broke up into spherical particles as the surface tension forces overcome the combined viscous and inertial forces. The particles fell spirally into the collection tray where a cooling water bath was maintained.

The experimental centrifugal head was housed in a metal chamber and the vapor inside the chamber was maintained close to the resid feed temperature using two kerosene-fired air heaters. The centrifugal head was heated close to the resid temperature using induction coil heaters. The metal chamber was heated to overcome the viscous force to form spherical particles, and this also reduced the throw-away diameter and inhibited stringing of the resid. Experiments were performed with single and multiple orifices and particles were produced successfully at high throughput. While operating with multiple orifices, the particles did not agglomerate in the vapor space or while falling into the collection tray.

Examples 1 and 2 illustrate the operation of the resid slurrying apparatus using a centrifugal extrusion device according to the principles of this invention and demonstrated the ability of this apparatus to successfully produce particles. Resid properties and operating parameters are presented in Table 2 below:

TABLE 2

| Property/Parameter | Example 1 | Example 2 |
|---|---|---|
| Resid Properties | | |
| R&B softening point, °F | 265 | 292 |
| Sulfur, wt% | 1.7 | 4.1 |
| Storage test to 150°F with axial load | Passed | Passed |
| Friability test, fines, wt% | <2 wt % | <2 wt % |
| Heating value, net, Btu/lb | 16,900 | 16,730 |
| Particle Size, mm | <0.1 | <0.1 |
| Operating Parameters | | |
| Centrifugal head diameter, inches | 2.4 | 2.4 |
| Total Number of Orifices | 32 | 32 |
| Number of orifices used | 1 | 1 and 4 |
| Orifice configuration | Triangular | Triangular |
| Orifice Diameter, inches | 0.03125 | 0.03125 |
| Throw-away diameter, ft | 3.5 to 5 | 3 to 5 ft |
| Resid feed temperature, °F | 500 | 535 |
| RPM | 1500 | 1500 |
| Throughput per orifice, lbs/hr | 195 | 100 |

What is claimed is:

1. A process for slurrying and oxidation of a petroleum resid, comprising the steps of:

(a) heating petroleum resid to a temperature at which it is in a liquid state;

(b) forming the resid into finely divided particles in a gaseous medium;

(c) directly quenching the resid particles with water to form a pumpable slurry of solidified resid particles;

(d) pumping the slurry to an oxidation reactor;

(e) injecting the slurry into the oxidation reactor and oxidizing the resid.

2. The process of claim 1 wherein the resid has a softening point temperature above about 185° F.

3. The process of claim 1 further comprising the steps of:

solvent deasphalting a petroleum residue to form a deasphalted oil fraction, an optional resin fraction and an asphaltene fraction;

supplying the asphaltene fraction as the petroleum resid for the heating step (a).

4. The process of claim 1 wherein the particle-forming step (b) and the quenching step (c) comprise the steps of:

(1) continuously feeding the liquid petroleum resid from step (a) to an inlet of a centrifugal prilling head comprising a plurality of radially arrayed discharge orifices;

(2) rotating the prilling head to discharge liquid petroleum resid from the orifices into free space at an upper end of a prilling vessel having a diameter larger than a throw-away diameter of the discharged resid;

(3) allowing the discharged resid to break apart and form into particles in a high temperature zone of the prilling vessel at which the resid is liquid and fall downwardly into a water bath maintained at a temperature effective to solidify the particles and form the pumpable slurry;

(4) withdrawing the slurry from the prilling vessel.

5. The process of claim 4 wherein the discharge orifices are arrayed at a circumference of the prilling head in a plurality of vertically spaced upper and lower rows wherein the lower row or rows are disposed at a smaller radius from an axis of rotation of the prilling head than the upper row or rows.

6. The process of claim 4 wherein the prilling head has a circumference tapered from an uppermost row to a lowermost row.

7. The process of claim 4 wherein the prilling head is rotated at from about 200 to about 10,000 rpm, the prilling head has a diameter from about 2 inches to about 5 feet, the orifices have a diameter from about 1/32-inch to about 1-inch and a capacity of from about 1 to about 1000 lbs/hr of resid per orifice, the throw-away diameter is from about 1 foot to about 15 feet and the particles have a size range larger than about 0.01 mm and smaller than about 1 mm.

8. The process of claim 4 wherein the bath is maintained in the prilling vessel at a temperature from about 40° to about 190° F.

9. The process of claim 8 wherein water is introduced into the prilling vessel as an inwardly directed spray in a cooling zone above the water bath to at least partially cool the particles before they enter the bath.

10. The process of claim 9 wherein the quenching water passes once through the prilling vessel, essentially free of recirculation, and wherein the slurry from the prilling vessel has a solids content from 50 to 80 percent.

11. The process of claim 9 wherein the quenching water is demineralized and the water is removed from the slurry from the prilling vessel to provide a solids content in the slurry from 50 to 80 percent, wherein the water removed is recirculated to the prilling vessel.

12. The process of claim 9 wherein water is added to the slurry from the prilling vessel to provide a water content from 50 to 80 percent.

13. The process of claim 1 further comprising the step of admixing a dispersant into the slurry to aid pumpability.

14. The process of claim 1 wherein the slurry comprises from 50 to 80 weight percent solids and has an apparent viscosity less than about 2000 cSt.

15. The process of claim 14 wherein the slurry comprises from 60 to 70 weight percent solids and has an apparent viscosity from about 100 to about 300 cSt.

16. The process of claim 14 wherein the particles have a size less than 0.05 mm.

17. The process of claim 1 wherein the oxidation reactor comprises a gasifier that converts the petroleum resid to synthesis gas.

18. The process of claim 17 wherein the gasifier comprises a high temperature, entrained flow, slagging type, oxygen blown gasifier.

19. The process of claim 17 wherein the gasifier is operated at a temperature from about 1800° to about 2600° F. and a pressure from about 400 to about 1200 psig.

20. The process of claim 1 wherein the oxidation reactor comprises a combustion reactor for converting the petroleum resid to hot combustion gases.

* * * * *